US011548297B2

(12) United States Patent
Suzuki

(10) Patent No.: US 11,548,297 B2
(45) Date of Patent: Jan. 10, 2023

(54) LIQUID DISCHARGE APPARATUS AND LIQUID DISCHARGE METHOD HAVING A CHANGING DRYING TARGET POSITION

(71) Applicant: Kazuki Suzuki, Kanagawa (JP)

(72) Inventor: Kazuki Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/348,923

(22) Filed: Jun. 16, 2021

(65) Prior Publication Data

US 2022/0032661 A1 Feb. 3, 2022

(30) Foreign Application Priority Data

Jul. 31, 2020 (JP) ..... JP2020-130706

(51) Int. Cl.
*B41J 11/00* (2006.01)

(52) U.S. Cl.
CPC ..... *B41J 11/00216* (2021.01)

(58) Field of Classification Search
CPC ..... B41J 11/00216; B41J 11/0021; B41J 11/00212; B41J 11/00218; B41J 11/002; B41J 2/01; B41J 11/0024
See application file for complete search history.

(56) References Cited

U.S. PATENT DOCUMENTS 6,447,112 B1 9/2002 Hu et al.
10,052,888 B1 8/2018 Condello et al.
2007/0165091 A1 7/2007 Oishi
2009/0015632 A1 1/2009 Suzuki et al.
2009/0122122 A1 5/2009 Kubo et al.
2010/0321426 A1 12/2010 Suzuki et al.
2012/0056932 A1 3/2012 Matsubara et al.
2012/0242737 A1 9/2012 Tanase et al.
2013/0044158 A1 2/2013 Suzuki
2013/0176361 A1 7/2013 Suzuki
2013/0222471 A1 8/2013 Suzuki
2015/0321488 A1 11/2015 Ohnishi
2018/0264822 A1 9/2018 Tanioku et al.
(Continued)

FOREIGN PATENT DOCUMENTS

CN 101003204 A 7/2007
CN 102689509 A 9/2012
JP 6-171074 6/1994
(Continued)

OTHER PUBLICATIONS

European Search Report; Application EP21179519; dated Oct. 25, 2021.

(Continued)

*Primary Examiner* — Bradley W Thies
(74) *Attorney, Agent, or Firm* — Duft & Bornsen, PC

(57) ABSTRACT

A liquid discharge apparatus includes a liquid discharge head, a drying unit, and circuitry. The liquid discharge head performs a liquid discharge operation that includes discharging liquid onto a medium. The drying unit radiates heat to dry the liquid adhering to the medium. The circuitry moves the liquid discharge head. Further, the circuitry changes a drying target position on the medium after the liquid discharge head performs the liquid discharge operation. The drying target position is an area where the heat from the drying unit reaches.

9 Claims, 14 Drawing Sheets

(56) References Cited

U.S. PATENT DOCUMENTS

| | | | | |
|---|---|---|---|---|
| 2018/0345682 | A1 | 12/2018 | Verhofstad et al. | |
| 2019/0134995 | A1* | 5/2019 | Rietbergen ..... | B41J 11/00212 |

FOREIGN PATENT DOCUMENTS

| | | | |
|---|---|---|---|
| JP | 06-171075 | | 6/1994 |
| JP | 2006-272731 | | 10/2006 |
| JP | 2007216388 | A | 8/2007 |
| JP | 2013-141796 | | 7/2013 |
| JP | 2020-151908 | | 9/2020 |

OTHER PUBLICATIONS

Chinese Office action; Application 202110821957.2; dated Nov. 3, 2022.

* cited by examiner

LIQUID DISCHARGE APPARATUS AND LIQUID DISCHARGE METHOD HAVING A CHANGING DRYING TARGET POSITION

CROSS-REFERENCE TO RELATED APPLICATION

This patent application is based on and claims priority pursuant to 35 U.S.C. § 119(a) to Japanese Patent Application No. 2020-130706, filed on Jul. 31, 2020, in the Japan Patent Office, the entire disclosure of which is hereby incorporated by reference herein.

BACKGROUND

Technical Field

Aspects of the present disclosure relate to a liquid discharge apparatus and a liquid discharge method.

Description of the Related Art

As a liquid discharge apparatus that discharge liquid, there is known an image forming apparatus that conveys a sheet-shaped recording medium along a medium conveyance guide plate to a position where the liquid discharged from a recording head reaches to form an image with a dot image of the liquid adhering to the recording medium. The medium conveyance guide plate is divided into a pre-guide plate, a platen plate, and a sheet ejection guide plate in order from the upstream side in a conveyance direction of the recording medium. A preheater, a print heater, and a post heater are disposed on the medium conveyance guide plate to heat the recording medium. The recording medium is conveyed on a conveyance face of the medium conveyance guide plate.

A drying unit dries the liquid adhering to the recording medium on the conveyance face of the sheet ejection guide plate. The recording medium is conveyed so as to face the conveyance face of the sheet ejection guide plate. The drying unit includes a heater (for example, a far-infrared heater) for drying liquid ink adhering to the surface (liquid adhering area) of the recording medium, and a fan for blowing heat of the heater to the recording medium. The fan forms a hot airflow upstream from the sheet ejection guide plate in the conveyance direction of the recording medium to assist in drying the liquid adhering area.

SUMMARY

Embodiments of the present disclosure describe an improved liquid discharge apparatus that includes a liquid discharge head, a drying unit, and circuitry. The liquid discharge head performs a liquid discharge operation that includes discharging liquid onto a medium. The drying unit radiates heat to dry the liquid adhering to the medium. The circuitry moves the liquid discharge head. Further, the circuitry changes a drying target position on the medium after the liquid discharge head performs the liquid discharge operation. The drying target position is an area where the heat from the drying unit reaches.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
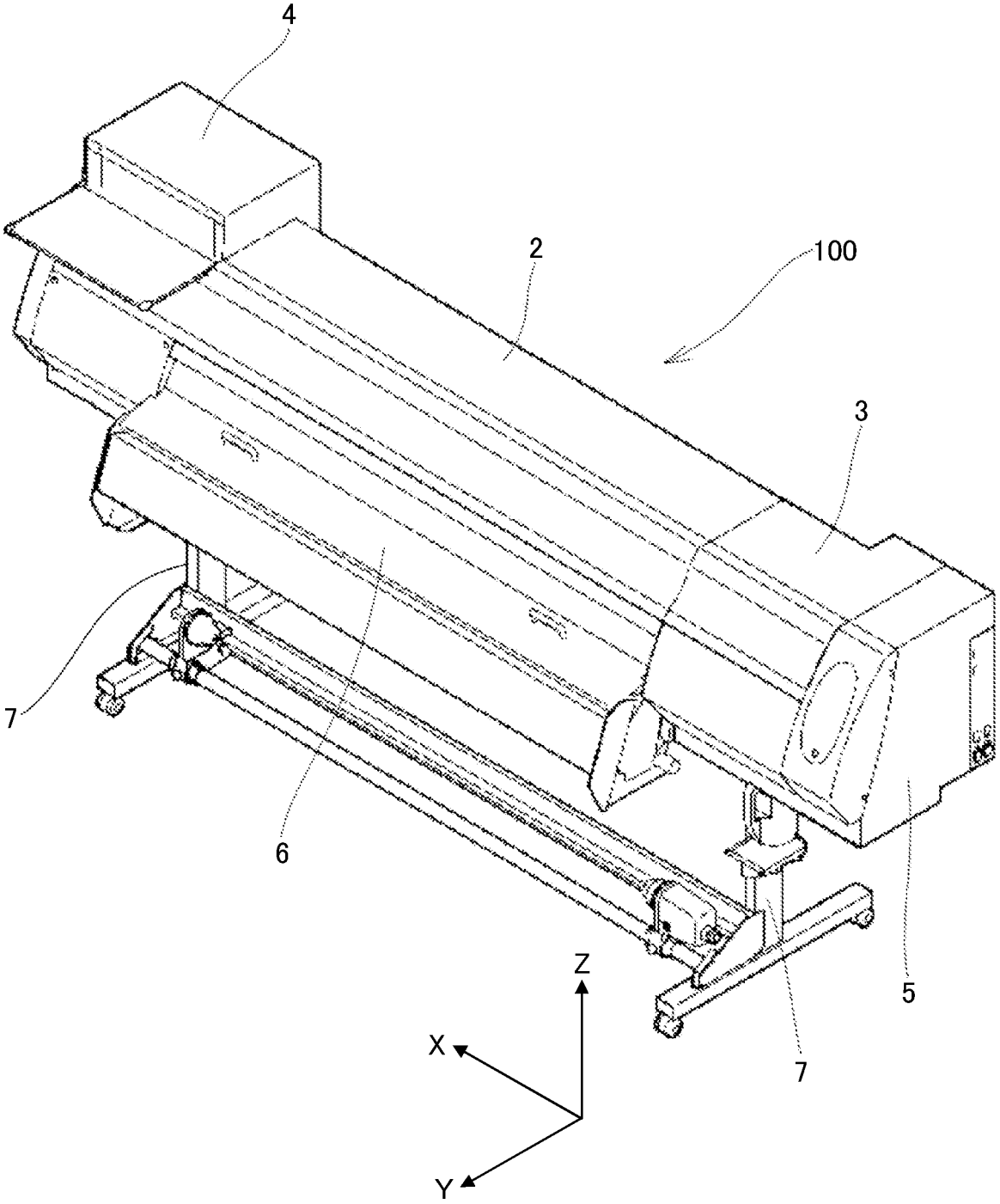
FIG. 1 is a schematic perspective view illustrating an overall configuration of an inkjet printer as an embodiment of a liquid discharge apparatus according to the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

It is to be noted that the suffixes y, m, c, and k attached to each reference numeral indicate only that components indicated thereby are used for forming yellow, magenta, cyan, and black images, respectively, and hereinafter may be omitted when color discrimination is not necessary.

Hereinafter, embodiments of a liquid discharge apparatus according to the present disclosure are described with reference to the drawings. FIG. 1 is a schematic perspective view illustrating an overall configuration of a printer 100 as an example of the liquid discharge apparatus according to the present embodiment. As illustrated in FIG. 1, a housing of the printer 100 has an exterior constructed of a center cover 2, a right cover 3 and a left cover 4 disposed on the left and right of the center cover 2, side plates 5 disposed at ends of the right cover 3 and the left cover 4, and an operation cover 6 that opens and closes with respect to the center cover 2. An apparatus body of the printer 100 covered with the respective covers (i.e., the center cover 2, the right cover 3, the left cover 4, the side plates 5, and the operation cover 6) is supported by left and right legs 7 with casters.

The printer 100 is an inkjet type image forming apparatus to form an image on a sheet medium that is wound in a roll (e.g., rolled paper). The printer 100 conveys the sheet medium as a recording medium and discharges liquid ink to the sheet medium. The recording medium may be a sheet medium made of a soft packaging medium, such as polyethylene terephthalate (PET), polyvinyl chloride (PVC), or oriented polypropylene (OPP), besides the rolled paper.

Figure 2:
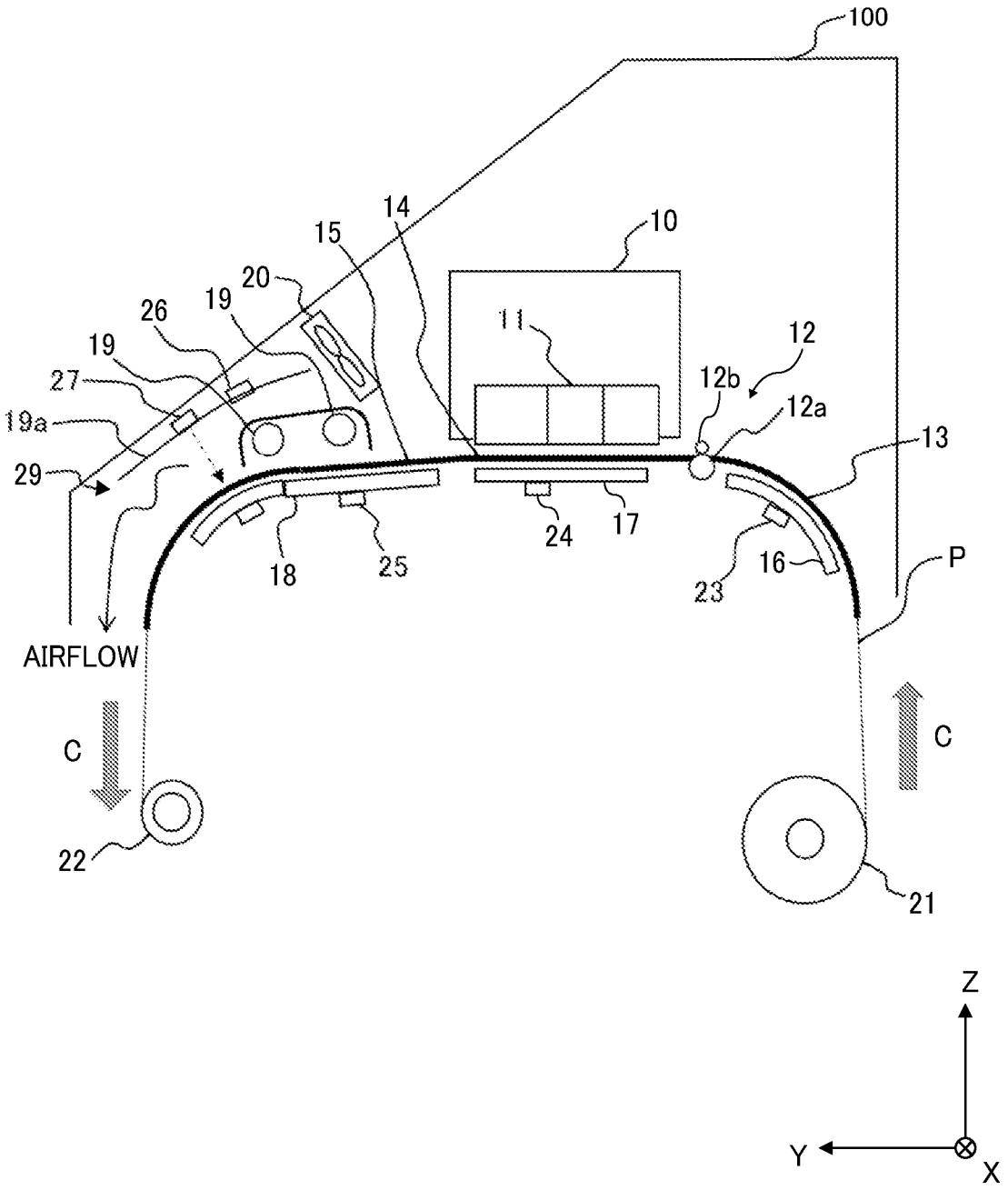
FIG. 2 is a cross-sectional side view illustrating an internal configuration of the inkjet printer.

FIG. 2 is a cross-sectional side view illustrating an internal configuration of the printer 100. The printer 100 includes a recording head (liquid discharge head) 11 as an image forming unit and a carriage 10 that slides together with the recording head 11 in a first direction perpendicular to a conveyance direction (second direction) of a sheet P as a recording medium. Thus, the carriage 10 moves in the main scanning direction.

The sheet P is fed out of the rolled sheet P wound around a sheet feeding roller 21, nipped by a conveyance roller pair 12, and conveyed downstream. The conveyance roller pair 12 includes a drive roller 12*a* and a pressure roller 12*b* that is pressed against the drive roller 12*a*. As the drive roller 12*a* is driven to rotate, the sheet P is nipped between the drive roller 12*a* and the pressure roller 12*b* and conveyed in the conveyance direction. A controller 101 (see FIG. 4) described later causes the drive roller 12*a* to rotate to control the start and stop of conveyance and the conveyance speed of the sheet P. The conveyance roller pair 12 is disposed near the downstream end of a sheet feeding guide plate 13.

The sheet feeding guide plate 13 serving as a pre-guide plate is disposed downstream from the sheet feeding roller 21 in the conveyance direction. The sheet P is conveyed to the conveyance roller pair 12 along the sheet feeding guide plate 13. A platen plate 14 is disposed downstream from the conveyance roller pair 12. The platen plate 14 supports the sheet P at a predetermined position during a liquid discharge operation in which the recording head 11 discharges liquid. The platen plate 14 maintains a distance in the vertical direction between a discharge face of a liquid discharge portion (nozzle) of the recording head 11 and the sheet P. The recording head 11 is reciprocally moved in the main scanning direction perpendicular to the conveyance direction with the carriage 10.

Figure 3:
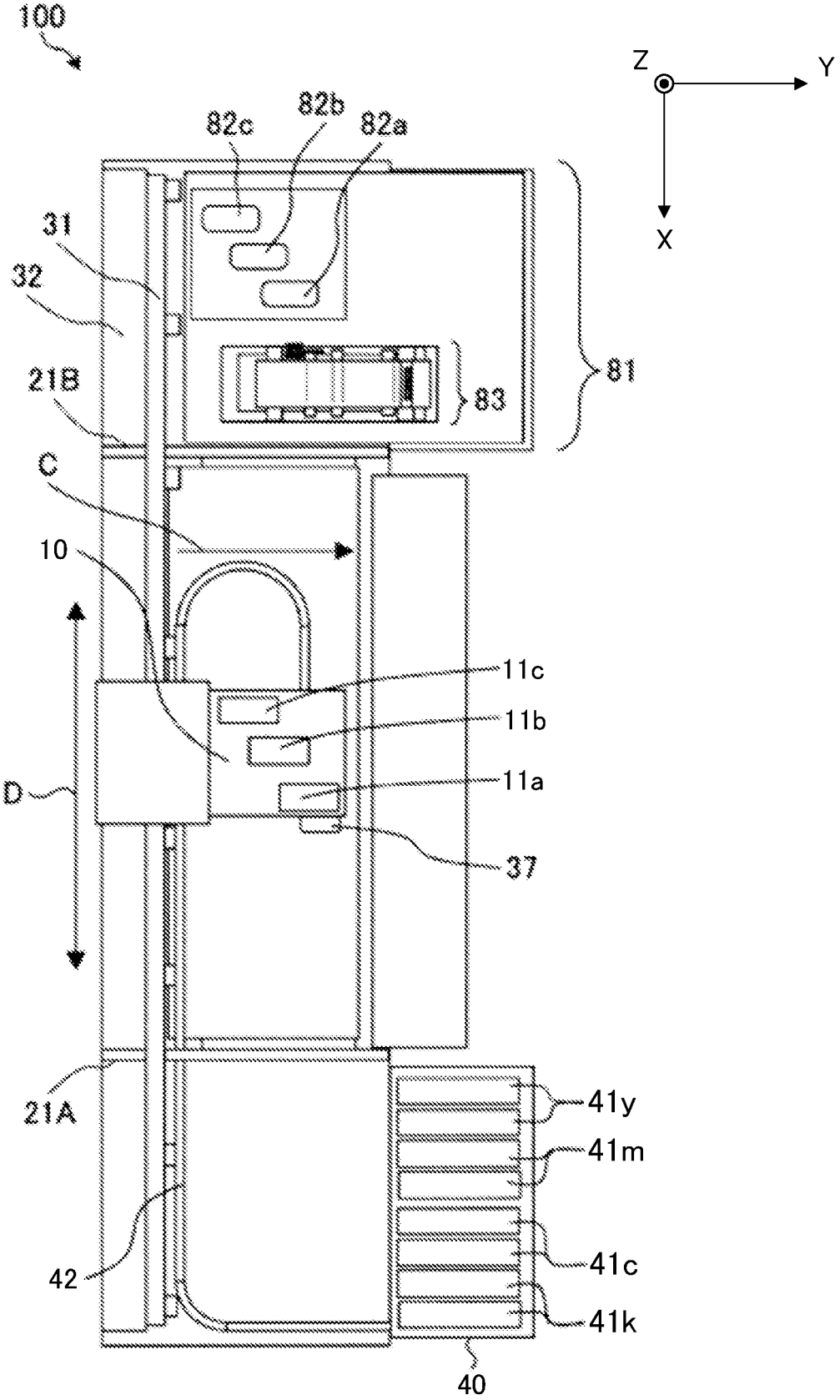
FIG. 3 is a plan view of a printing mechanism included in the inkjet printer.

A sheet ejection guide plate 15 serving as a post guide plate is disposed downstream from the platen plate 14 in the conveyance direction. The sheet feeding guide plate 13, the platen plate 14, the sheet ejection guide plate 15, and the conveyance roller pair 12 constitute a conveyance unit. The conveyance direction in which the sheet P is conveyed by the conveyance unit is defined as the sub-scanning direction C, and the direction in which the carriage 10 is reciprocally moved, which is perpendicular to the sub-scanning direction C, is defined as the main scanning direction D as illustrated in FIG. 3.

A preheater 16 is disposed on the surface of the sheet feeding guide plate 13 opposite a conveyance face of the sheet feeding guide plate 13 on which the sheet P is conveyed. The preheater 16 preheats a liquid adhering area on an image forming surface of the sheet P to a suitable temperature for liquid ink to adhere to the sheet P. An image is formed in the liquid adhering area with the liquid ink adhering to the sheet P. The preheater 16 such as an aluminum foil heater is attached to the back surface of the sheet feeding guide plate 13. The preheater 16 heats the sheet feeding guide plate 13, thereby heating the sheet P. The sheet P preheated by the preheater 16 is nipped between the drive roller 12*a* and the pressure roller 12*b* and conveyed to the platen plate 14. The carriage 10 and the recording head 11 as an image forming unit are disposed above the platen plate 14.

A platen heater 17 is disposed on the surface of the platen plate 14 opposite a conveyance face of the platen plate 14 on which the sheet P is conveyed. While the platen heater 17 keeps the sheet P warm, liquid discharged from the recording head 11 adheres to the sheet P, thereby forming an image (the liquid adhering surface) on the image forming surface of the sheet P. The platen heater 17 is, for example, a cord heater embedded in the platen plate 14 made of an aluminum material. The platen heater 17 heats the platen plate 14, thereby heating the sheet P.

A post heater 18 is disposed on the surface of the sheet ejection guide plate 15 opposite a conveyance face of the sheet ejection guide plate 15 on which the sheet P is conveyed. When the sheet P on which the liquid adhering area is formed is conveyed to the sheet ejection guide plate 15, the post heater 18 dries the liquid adhering area together with a drying unit 29 to fix the image formed of the liquid ink on the sheet P. The post heater 18 such as an aluminum foil heater is attached to the back surface of the sheet ejection guide plate 15. The post heater 18 heats the sheet ejection guide plate 15, thereby heating the sheet P.

The drying unit 29 is disposed above the sheet ejection guide plate 15. The drying unit 29 includes a far-infrared heater 19 as a heater and a drying fan 20 as a heat transfer device. A far-infrared heater support 19*a* holds the far-infrared heater 19 at a predetermined position. The drying fan 20 blows air heated by the far-infrared heater 19 to the sheet P to facilitate drying the sheet P.

The far-infrared heater 19 radiates far-infrared rays to the liquid adhering area of the sheet P to dry (heat) the liquid adhering area in a non-contact manner. The sheet P on which the liquid adhering area has been dried and the liquid has been fixed is further conveyed downstream in the conveyance direction. The drying fan 20 is disposed so as to send the air heated by the far-infrared heater 19 downstream in the conveyance direction. The hot airflow from the drying fan 20 flows along the sheet P on the sheet ejection guide plate 15, thereby facilitating drying the sheet P. The sheet P conveyed downstream from the drying unit 29 is wound around an output roller 22.

The preheater 16 is provided with a preheater temperature sensor 23. The platen heater 17 is provided with a platen heater temperature sensor 24. The post heater 18 is provided with a post heater temperature sensor 25. The far-infrared heater support 19*a* supports a far-infrared heater temperature sensor 26 disposed near the far-infrared heater 19. The far-infrared heater temperature sensor 26 detects temperature in a non-contact manner. The drying unit 29 is provided with a medium surface temperature sensor 27 that detects the surface temperature of the sheet P.

The preheater 16, the platen heater 17, the post heater 18, and the far-infrared heater 19 (hereinafter collectively referred to as "heaters") start operations when the printer 100 returns from a sleep mode and transition to a state in which the heaters are ready to heat. At this time, the heaters are controlled to reach set temperatures set in advance according to the type of the sheet P and the operation mode of the printer 100. The printer 100 starts an initial operation related to a process for forming an image on the sheet P while controlling the temperatures of the heaters to reach the set temperatures. When the printer 100 starts the liquid discharge operation (image forming operation) on the sheet P, the far-infrared heater 19 starts heating to reach a temperature for drying the liquid adhering area. Further, the controller 101 causes the far-infrared heater 19 to move to the position facing the liquid adhering area after the image forming operation including predetermined operation units is finished. It takes several seconds for the far-infrared heater 19 to be heated and moved to a predetermined position. Meanwhile, the sheet P stops at a stop position when the image forming operation is completed by the recording head 11, and waits for the far-infrared heater 19 to move to the extreme downstream end of the liquid adhering area in the conveyance direction.

The controller 101 causes the far-infrared heater 19 to move upstream in the conveyance direction of the sheet P and toward a position where the liquid adhering area of the sheet P is to be dried. At that time, the sheet P stops at the stop position. During this movement, the far-infrared heater 19 is preheated so that the temperature of a filament of the far-infrared heater 19 reaches a target temperature. Then, the far-infrared heater 19 reaches the set temperature in synchronization with the timing of movement and arrival at the predetermined position. Thus, the far-infrared heater 19 is ready to dry the sheet P at the predetermined set temperature (i.e., a dryable state). The timing at which the far-infrared heater 19 is ready to dry the liquid adhering area can be changed according to the type of the sheet P or the mode of the printer 100. The far-infrared heater 19 does not reach the dryable state at the same time when the printer 100 returns from the sleep mode to prevent deterioration of the sheet P heated by unnecessary radiation from the far-infrared heater 19.

When the sheet P is dried at high temperature (when a drying temperature of the sheet P is high), moisture contained in the liquid ink landed on the sheet P evaporates fast, and leveling of the liquid (dot) is suppressed. The leveling is a phenomenon in which the liquid landed (imaged) on the sheet P spreads on the sheet P. When the density of dots formed on the sheet P is high and the distance between adjacent dots is short, the adjacent dots are likely to merge into a large single dot. In other words, when the drying temperature of the sheet P is high, the leveling is less likely to occur. As a result, the adjacent dots are prevented from merging, and independent dots are likely to be formed. On the other hand, when the drying temperature of the sheet P is low, the leveling of the dots is likely to occur. As a result, the adjacent dots are likely to merge into the single dot. When the dots are independent of each other, the liquid adhering area on the image forming surface of the sheet P is likely to be uneven, thereby decreasing the glossiness of the liquid adhering area. On the other hand, when adjacent dots merge with each other, the liquid adhering area on the image forming surface is likely to be smooth, thereby increasing the glossiness of the liquid adhering surface. Based on the above, the glossiness of the liquid adhering area formed on the image forming surface of the sheet P is adjustable by appropriately adjusting the drying temperature of the sheet P.

FIG. 3 is a plan view illustrating the configuration of the image forming unit included in the printer 100 and the surrounding thereof in detail. As illustrated in FIG. 3, the printer 100 is a wide, serial-type inkjet recording apparatus. In the printer 100 according to the present embodiment, the carriage 10 is slidably held by a main guide rod 31 and a sub plate guide 32. The main guide rod 31 and the sub plate guide 32 are laterally bridged between left and right inner side walls 21A and 21B standing inside the apparatus body of the printer 100 to guide the carriage 10. In the printer 100, the carriage 10 is moved in the main scanning direction D as illustrated in FIG. 3 by a main scanning motor 117 (see FIG. 4) via a timing belt.

The carriage 10 includes recording heads 11 (11*a*, 11*b*, and 11*c*) that discharge inks (an example of liquid) of respective colors such as yellow (Y), cyan (C), magenta (M), orange (O), green (G), and clear (Cl) onto a recording medium. Hereinafter, each of the recording heads 11 (11*a*, 11*b*, and 11*c*) is simply referred to as the recording head 11 unless particularly distinguished. The recording head 11 includes a plurality of nozzle arrays arranged in the main scanning direction D. Multiple nozzles in each nozzle array are arranged in the sub-scanning direction C perpendicular to the main scanning direction D. The recording head 11 discharges ink downward through the multiple nozzles. In the carriage 10, the recording heads 11 are arranged at different positions along the sub-scanning direction C.

Further, the carriage 10 includes sub tanks for supplying inks of respective colors. The sub tanks correspond to the respective recording heads 11. The inks of the respective colors are supplied (replenished) to the sub tanks from ink cartridges 41*y*, 41*m*, 41*c*, and 41*k* via supply tubes 42 of the respective colors by a supply pump unit. The ink cartridges 41*y*, 41*m*, 41*c*, and 41*k* are removably mounted on a cartridge mount 40. An optical sensor 37 that detects an end of the recording medium such as a paper sheet is mounted on the carriage 10. Here, the optical sensor 37 is a so-called two-dimensional sensor. The two-dimensional sensor is secured to the carriage 10. When the carriage 10 moves in the main scanning direction, a light source of the two-dimensional sensor irradiates an imaging target (e.g., the recording medium) with light, and an imaging sensor of the two-dimensional sensor receives the reflected light, thereby obtaining two dimensional image data (captured image).

Further, a maintenance unit 81 is disposed in a non-printing area adjacent to one end of a printing area by the carriage 10 in the main scanning direction D. The maintenance unit 81 maintains and recovers a discharge function of the nozzles of the recording head 11. The maintenance unit 81 includes caps 82*a*, 82*b*, and 82*c* to respectively cap nozzle faces of the recording heads 11 and a wiper unit 83 to wipe the nozzle faces. A replaceable waste liquid tank is disposed below the maintenance unit 81. The waste liquid tank accommodates waste liquid generated in the maintenance and recovery operation for the recording head 11.

The carriage 10 is movably supported. For example, the carriage 10 can move to a retracted position outside the inner side wall 21A in the X direction (first direction). The carriage 10 moves to the retracted position after a certain image forming operation (liquid discharge operation) is completed. The retracted position corresponds to a position outside the side edge of the sheet P conveyed in the sub-scanning direction C.

Figure 4:
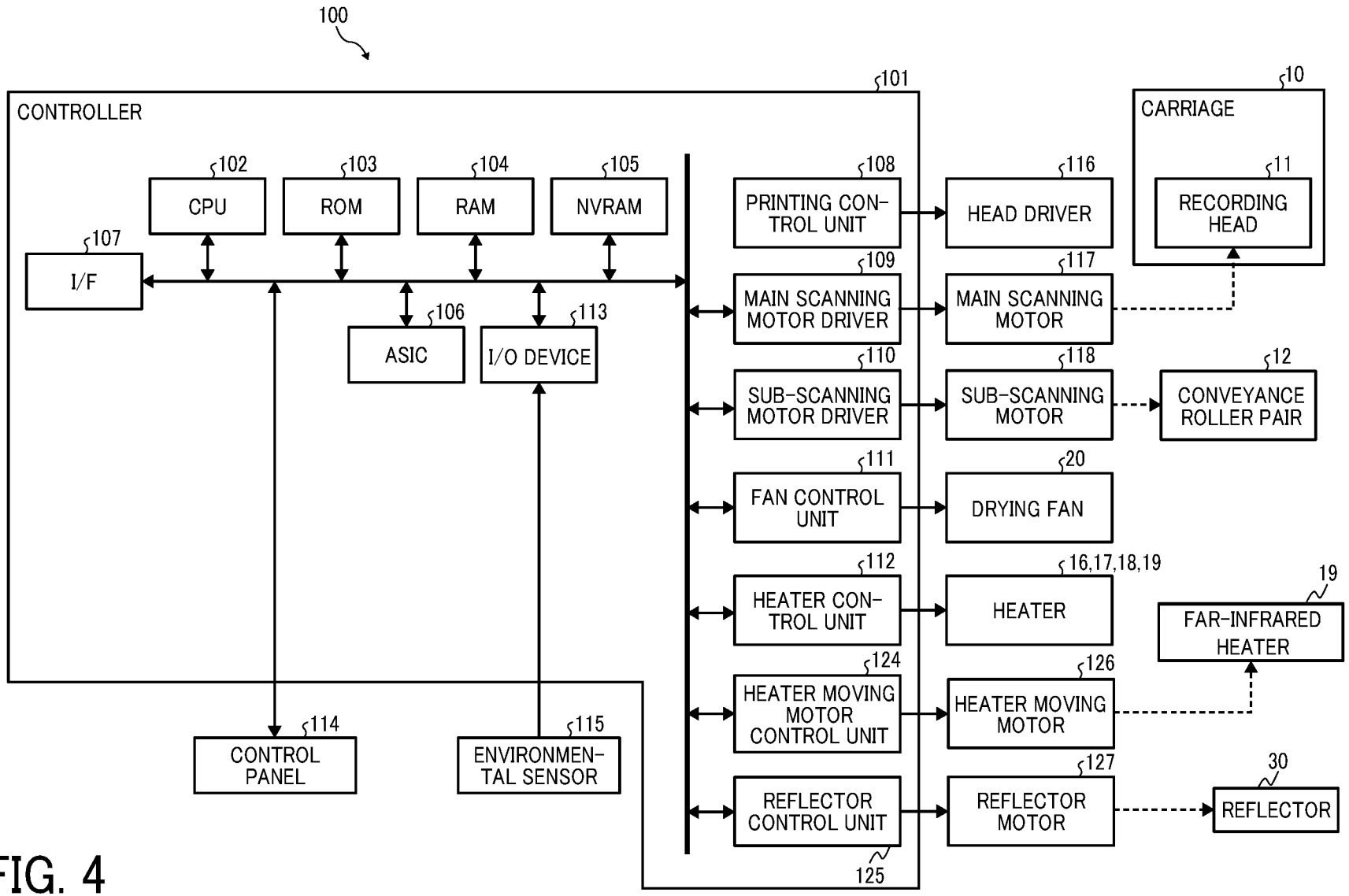
FIG. 4 is a block diagram illustrating a functional configuration of a controller included in the inkjet printer.

Next, a description is given of the hardware configuration of the controller 101 of the printer 100 as circuitry that controls the operation of the printer 100. As illustrated in FIG. 4, the printer 100 includes the controller 101, a control panel 114, an environmental sensor 115, a head driver 116, a main scanning motor 117, a sub-scanning motor 118, the drying fan 20, the heaters (the preheater 16, the platen heater 17, the post heater 18, and the far-infrared heater 19), the carriage 10, the conveyance roller pair 12, a heater moving motor 126, and a reflector motor 127.

The controller 101 includes a central processing unit (CPU) 102 that controls the entire system of the printer 100. In the printer 100, a read only memory (ROM) 103, a random access memory (RAM) 104, a nonvolatile memory 105 such as a nonvolatile random access memory (NVRAM), and an application specific integrated circuit (ASIC) 106 are connected to the CPU 102.

The ROM 103 stores programs executed by the CPU 102 and other fixed data. The RAM 104 temporarily stores image data and the like. The nonvolatile memory 105 can store data even while the printer 100 is powered off. The ASIC 106 performs various types of signal processing on image data, image processing such as sorting, and other input/output signal processing to control the entire system of the printer 100.

The controller 101 further includes an interface (I/F) 107, a printing control unit 108, a main scanning motor driver 109, a sub-scanning motor driver 110, a fan control unit 111, a heater control unit 112, an input/output (I/O) device 113, a heater moving motor control unit 124, and a reflector control unit 125. The control panel 114 and the environmental sensor 115 are connected to the controller 101.

The I/F 107 transmits and receives various kinds of data and various kinds of signals to and from a host device. Specifically, the I/F 107 receives image data generated by a printer driver of the host device such as a data processor, an image reading device, or an imaging device via a cable or a network. That is, the printer driver of the host device may output the image data to the controller 101. The CPU 102 reads and analyzes the image data stored in a reception buffer included in the I/F 107. The ASIC 106 performs the image processing on the image data analyzed by the CPU 102, and transmits the processed image data (print data) to the printing control unit 108 and the head driver 116.

The printing control unit 108 generates a drive signal having a waveform for driving the recording head (liquid discharge head) 11, and outputs the print data accompanied with various data to the head driver 116. A pressure generator of the recording head 11 is selectively driven based on the print data and generates pressure to cause the recording head 11 to discharge liquid from the nozzles. A unit of the image forming operation in which the respective recording heads 11 discharge liquid ink and an image is formed on the sheet P is referred to as a "print job." In the print job, the liquid adhering area having a predetermined size is formed on the sheet P. The print job of the printer 100 corresponds to a unit of the drying process. After a certain liquid adhering area is formed, the liquid adhering area is dried in the drying process. Therefore, in the printer 100, the drying unit 29 performs the drying process in conjunction with the print job.

The printing control unit 108 may be a data processor having the same configuration as the CPU 102, the ROM 103, and the RAM 104. A function of the printing control unit 108 corresponding to the CPU 102 executes a print control program stored by a function corresponding to the ROM 103. Thus, the image formation is performed to form the liquid adhering area. The print control program executed by the printing control unit 108 is a file in an installable format or an executable format. The print control program may be stored in advance in the function corresponding to the ROM 103 or may be provided from an external storage medium.

Alternatively, the print control program executed by the printing control unit 108 may be stored in a computer connected to a network such as the Internet, and the print control program may be downloaded from the computer via the network. Further, the print control program to be executed in the printing control unit 108 may be provided or distributed through the network such as the Internet to the printing control unit 108.

The main scanning motor driver 109 drives the main scanning motor 117. The main scanning motor 117 is driven to move the carriage 10 including the recording head 11 in the main scanning direction D. The sub-scanning motor driver 110 drives the sub-scanning motor 118. The sub-scanning motor 118 is driven to rotate the conveyance roller pair 12 that conveys an object to which the recording head 11 discharges liquid. The fan control unit 111 controls the output of the drying fan 20 to blow air at a predetermined temperature and air volume. The heater control unit 112 controls a heating start timing, a heating stop timing, and temperatures of the heaters (the preheater 16, the platen heater 17, the post heater 18, and the far-infrared heater 19) to heat the recording medium to the set temperature.

The heater moving motor control unit 124 controls the heater moving motor 126 that moves (changes) a relative relation of the heat from the drying unit 29 with respect to the liquid adhering area. The heater moving motor 126 moves the far-infrared heater 19 of the drying unit 29 upstream in the sub-scanning direction. In the drying process, the heater moving motor control unit 124 changes a relative position between the far-infrared heater 19 and the sheet P. The far-infrared heater 19 radiates heat (radiant heat) to the sheet P in the drying process, thereby drying the liquid adhering area of the sheet P. Here, "change the relative position between the far-infrared heater 19 and the sheet P" means that the position (drying target position) at which the sheet P is dried by the radiant heat of the far-infrared heater 19 is changed. That is, the far-infrared heater 19 is moved upstream in the conveyance direction of the sheet P, thereby changing the position at which the sheet P receives the radiant heat. In other words, the far-infrared heater 19 is moved so that the drying target position of the sheet P to which the far-infrared heater 19 radiates the radiant heat approaches the liquid adhering area, thereby changing the relative position. Thus, the far-infrared heater 19 can radiate the heat while moving. As described later, the far-infrared heater 19 can move near the extreme upstream end of the liquid adhering area formed on the sheet P in the conveyance direction.

Figure 5:
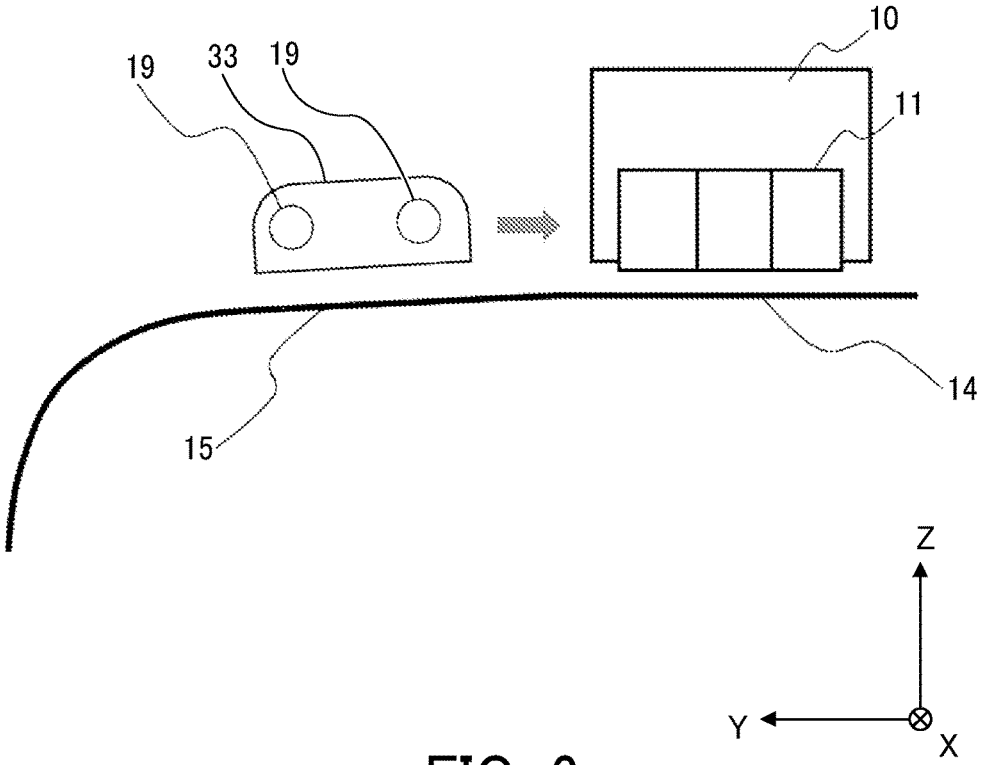
FIG. 5 is a schematic diagram illustrating an operation of a drying unit according to a first embodiment.
Figure 6:
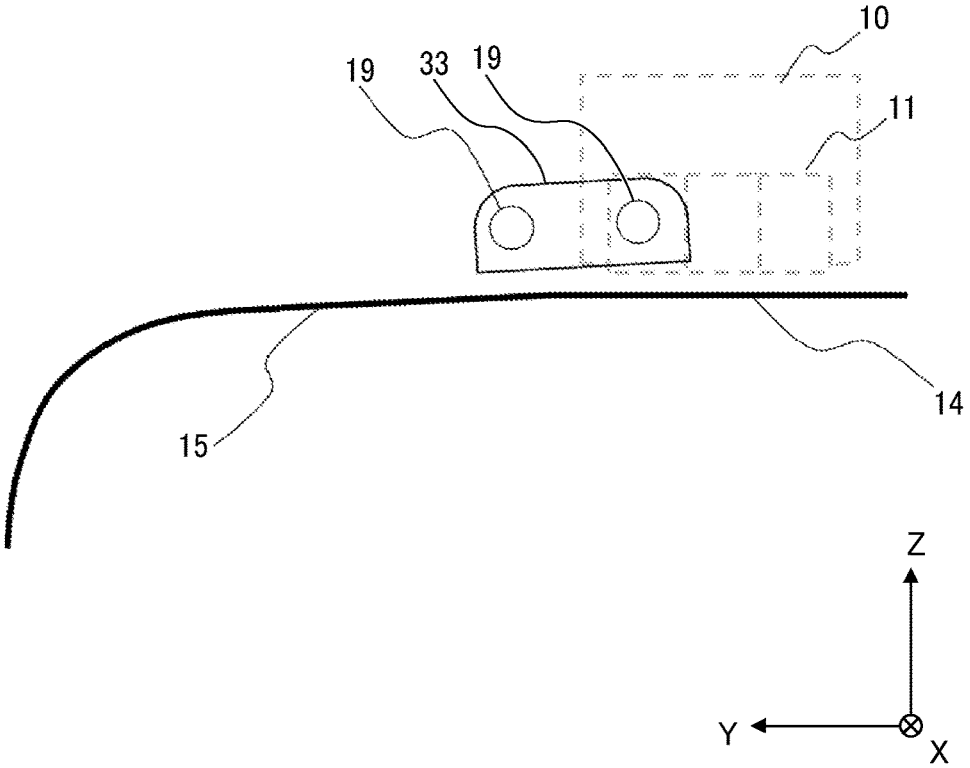
FIG. 6 is a schematic diagram illustrating the operation of the drying unit according to the first embodiment.

For example, as illustrated in FIG. 5, when the heater moving motor control unit 124 causes the heater moving motor 126 to move the far-infrared heater 19 upstream in the conveyance direction, the temperature of the far-infrared heater 19 is controlled so as to heat the sheet P to the suitable temperature to dry the liquid adhering area on the sheet P. In other words, the heater control unit 112 controls the temperature of the far-infrared heater 19 to a predetermined temperature by the time the far-infrared heater 19 reaches a position facing the liquid adhering area on the sheet P to be dried with the heat radiated from the far-infrared heater 19. As illustrated in FIG. 6, the far-infrared heater 19 supported by a heater support 33 is moved so as to reach a predetermined position above the liquid adhering area as the drying target position of the sheet P by the radiant heat. At this time, the position where the drying unit 29 (the far-infrared heater 19) reaches overlaps with the range in which the carriage 10 moves in the main scanning direction during main scanning. The moving speed of the far-infrared heater 19 is set depending on the conveyance speed of the sheet P.

Figure 7:
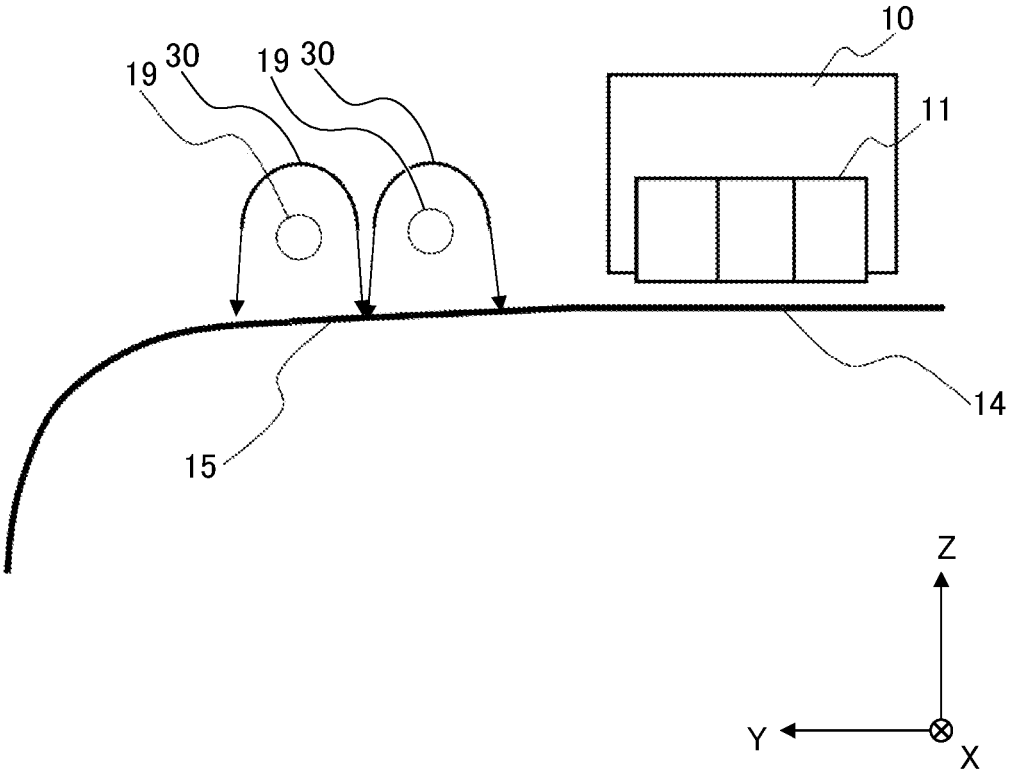
FIG. 7 is a schematic diagram illustrating an operation of the drying unit according to a second embodiment.
Figure 8:
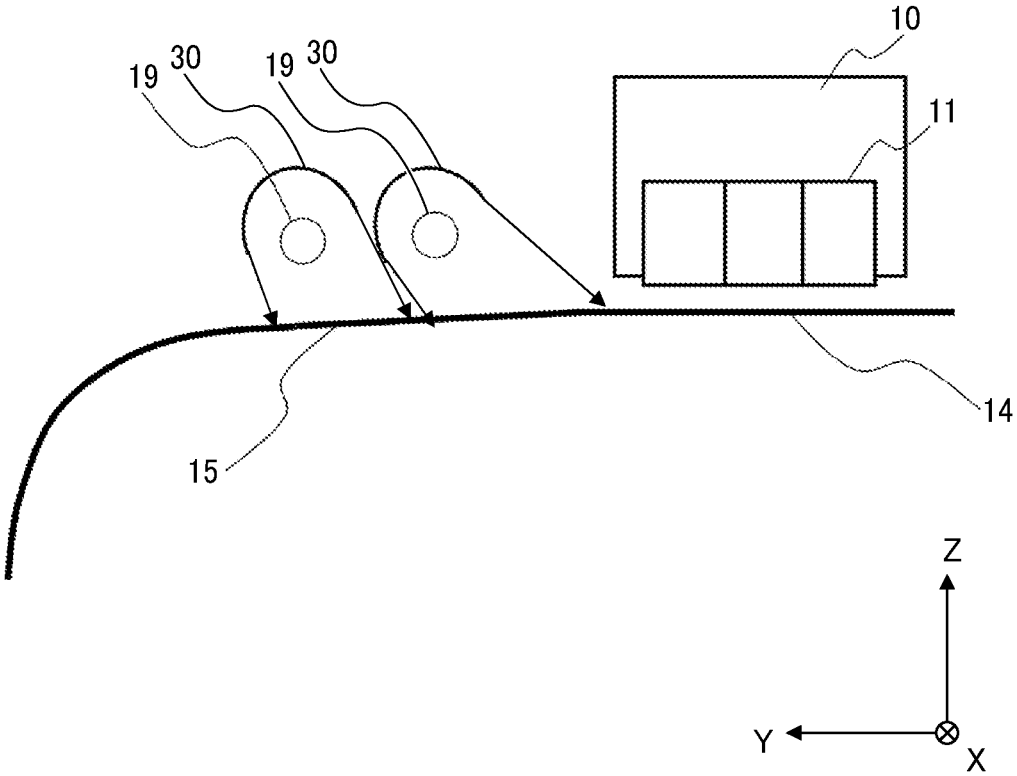
FIG. 8 is a schematic diagram illustrating the operation of the drying unit according to the second embodiment.

As illustrated in FIGS. 7 and 8, the reflector control unit 125 causes the reflector motor 127 to swing a reflector 30 that reflects the radiant heat from the far-infrared heater 19 toward the sheet P. As the reflector 30 is swung, a reflection direction of the radiant heat of the far-infrared heater 19 reflected on the reflector 30 is changed. Thus, the above-described "change the relative position (drying target position)" also corresponds to "change the reflection direction of the radiant heat" using the reflector 30. The reflection direction of the radiant heat reflected on the reflector 30 is appropriately changed between the downward direction from the far-infrared heater 19 as illustrated in FIG. 7 and the upstream direction from the far-infrared heater 19 in the conveyance direction of the sheet P as illustrated in FIG. 8. Thus, after the liquid adhering area of the sheet P stops being conveyed below the carriage 10, the reflection direction of the radiant heat of the far-infrared heater 19 is changed, thereby drying the liquid adhering area without moving the far-infrared heater 19 to the position above the liquid adhering area.

The I/O device 113 receives a detection result of an environment temperature, an environment moisture, or the like obtained by the environmental sensor 115, and extracts data required for controlling each unit of the printer 100. Various detection signals from various sensors other than the environmental sensor 115 are also input to the I/O device 113. The control panel 114 inputs and displays various data.

Next, a flow of the drying process is described. The drying process is performed following the liquid discharge operation on the sheet P in the printer 100. Before the detailed description of the embodiments according to the present disclosure, a comparative example of the flow of the drying process is described. The operation of the comparative example can also be performed with the configuration of the printer 100 according to the present disclosure. Therefore, a description is given below of the comparative example of the drying process performed in the printer 100 according to the present disclosure.

Figure 9:
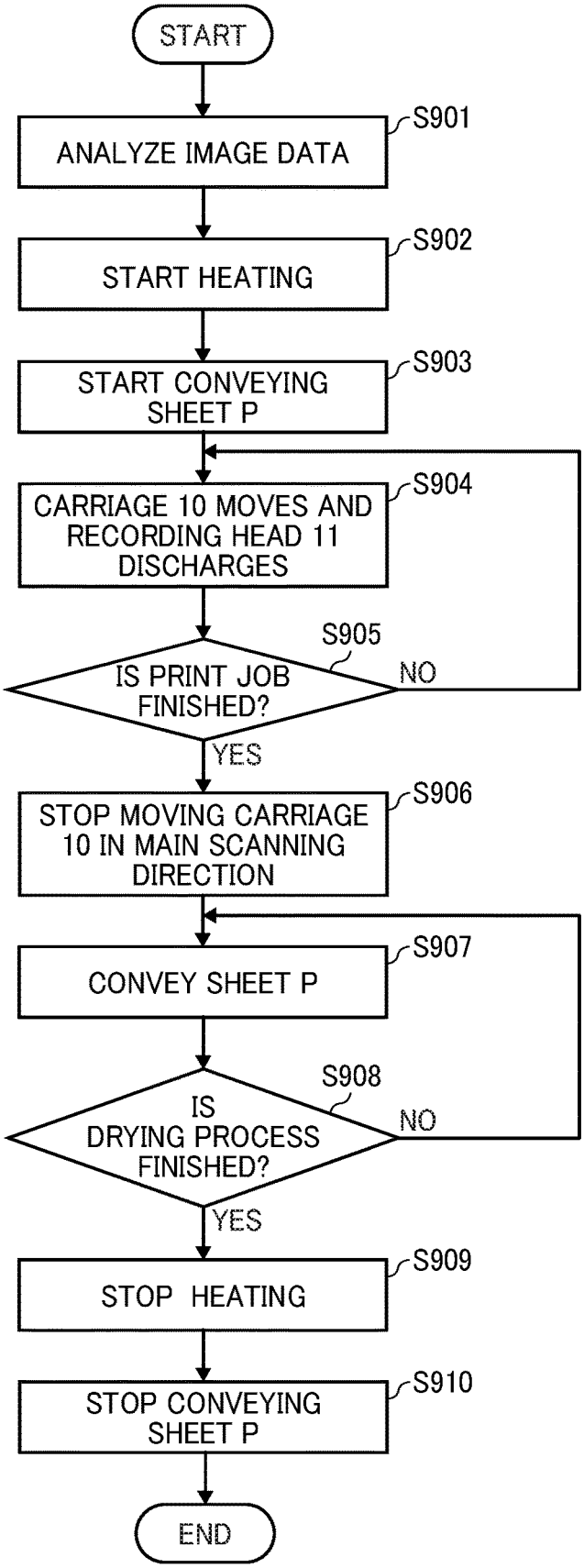
FIG. 9 is a flowchart illustrating a comparative example of a drying process executed by the controller included in the inkjet printer.

FIG. 9 is a flowchart illustrating the comparative example. First, the CPU 102 reads and analyzes image data stored in the reception buffer of the I/F 107. The ASIC 106 performs the image processing and sorting on the image data analyzed by the CPU 102, and transmits the image data to the printing control unit 108 (S901).

The printing control unit 108 outputs the image data and drive signals to the head driver 116 at a required timing. Specifically, the printing control unit 108 converts from digital to analog and amplifies pattern data of drive pulses to generate a drive signal including one drive pulse or a plurality of drive pulses. The pattern data is read from the ROM 103 by the CPU 102. Alternatively, the CPU 102 may use font data in the ROM 103, or the printer driver of the host device may convert image data into a bitmap format and transmit the converted image data to the printer 100 to generate image data (e.g., dot pattern data) for forming an image on the sheet P.

Subsequently, the heater control unit 112 causes the heaters including the far-infrared heater 19 to start heating (S902). Then, the sub-scanning motor 118 drives the conveyance roller pair 12 to start conveying the sheet P (S903). The head driver 116 applies the drive pulse to the pressure generator of the recording head 11 based on input image data (e.g., the dot pattern data). The drive pulse constitutes the drive signal input from the printing control unit 108. As the drive pulse is applied to the pressure generator, the recording head 11 discharges liquid ink. At this time, the recording head 11 discharges the liquid ink while the main scanning motor 117 moves the carriage 10 in the main scanning direction (S904).

Figure 10:
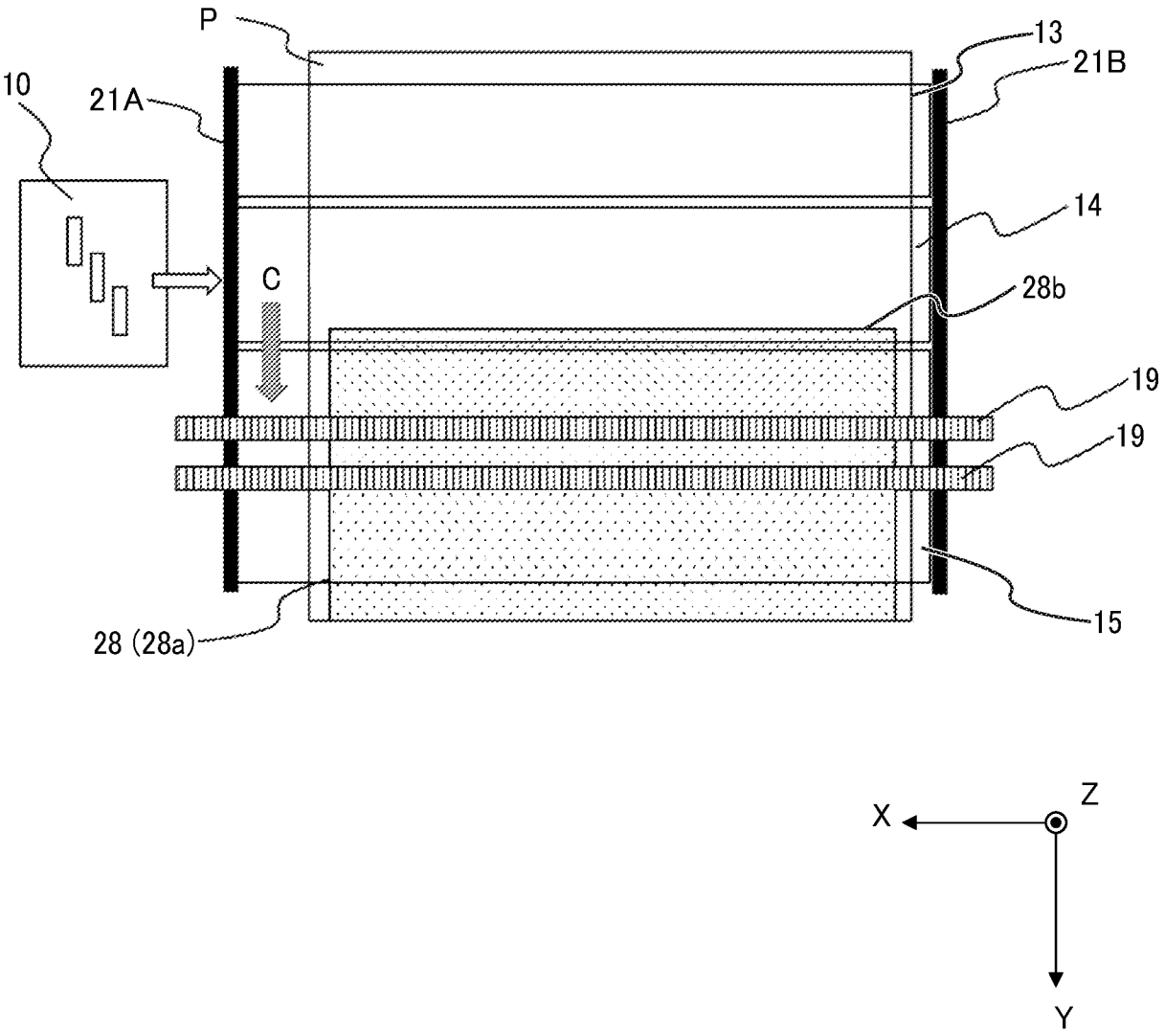
FIG. 10 is a schematic diagram illustrating a positional relation between the drying unit and a recording medium according to the comparative example.

Step S904 is repeated until the printing control unit 108 finishes a series of image forming operations (print jobs) (No in S905). When the print job is finished (Yes in S905), the main scanning motor driver 109 stops the main scanning motor 117 to stop moving the carriage 10 in the main scanning direction to finish the main scanning of the carriage 10 (S906). At this time, as illustrated in FIG. 10, a rear end 28*b* of an image 28*a* is conveyed to the downstream end of the platen plate 14 in the conveyance direction. The rear end 28*b* of the image 28*a* is a position to which the liquid ink adheres at the end of the liquid discharge operation, that is, an end position of the liquid adhering area 28 formed on the sheet P.

Subsequently, the sub-scanning motor driver 110 causes the sub-scanning motor 118 to rotate the conveyance roller pair 12, thereby conveying the liquid adhering area of the sheet P downstream in the conveyance direction (S907). At this time, the conveyance roller pair 12 continue conveying the sheet P until the rear end 28*b* of the image 28*a* on the sheet P passes through the far-infrared heater 19 and the drying process on the liquid adhering area 28 is finished (S907 and No in S908). After the entire liquid adhering area 28 passes through the far-infrared heater 19 (Yes in S908), the heater control unit 112 causes the far-infrared heater 19 to stop heating (S909). Then, the sub-scanning motor driver 110 causes the sub-scanning motor 118 to stop rotating, and the conveyance roller pair 12 stops conveying the sheet P (S910).

Figure 11:
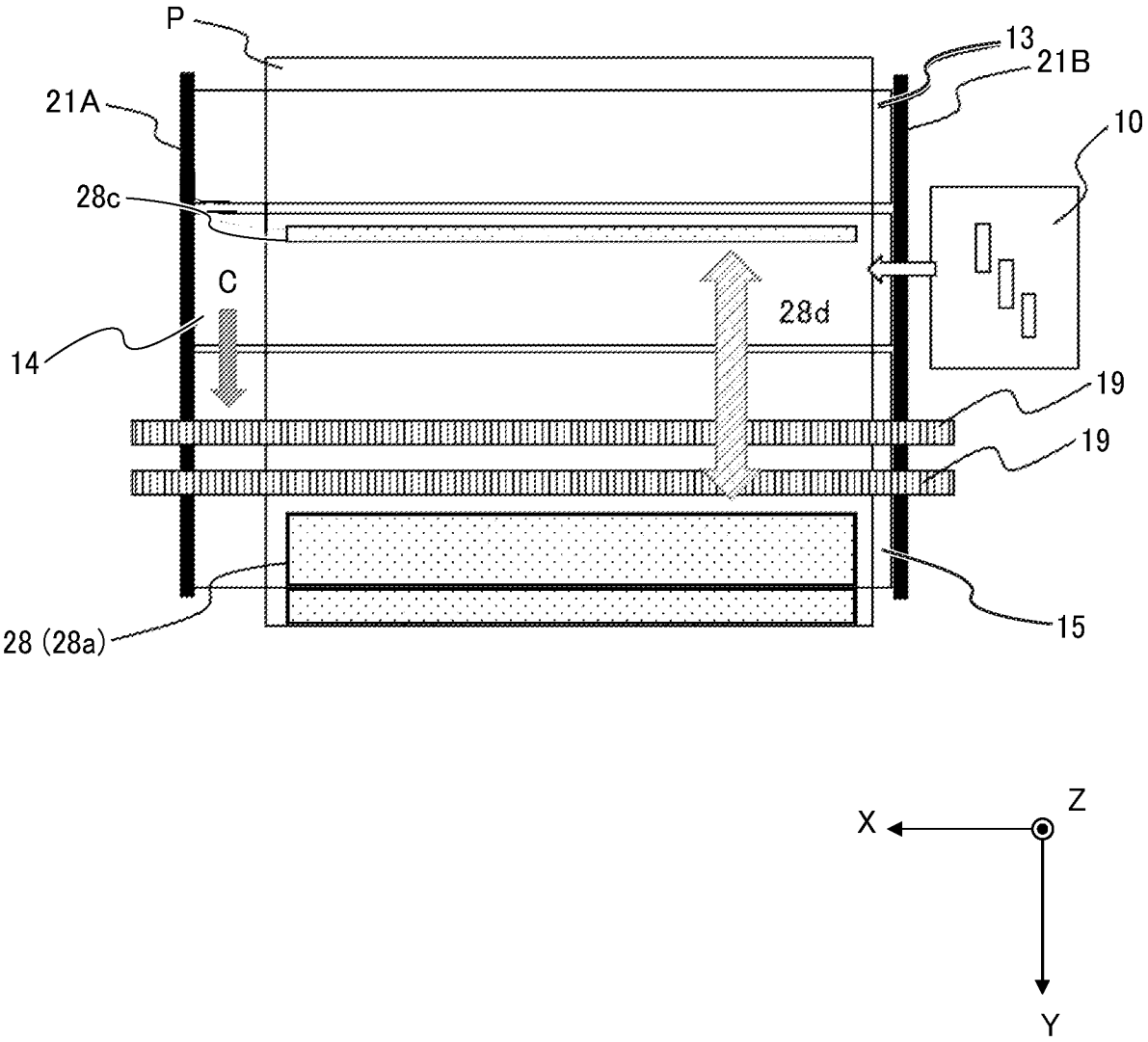
FIG. 11 is a schematic diagram illustrating the positional relation between the drying unit and the recording medium according to the comparative example.
Figure 12:
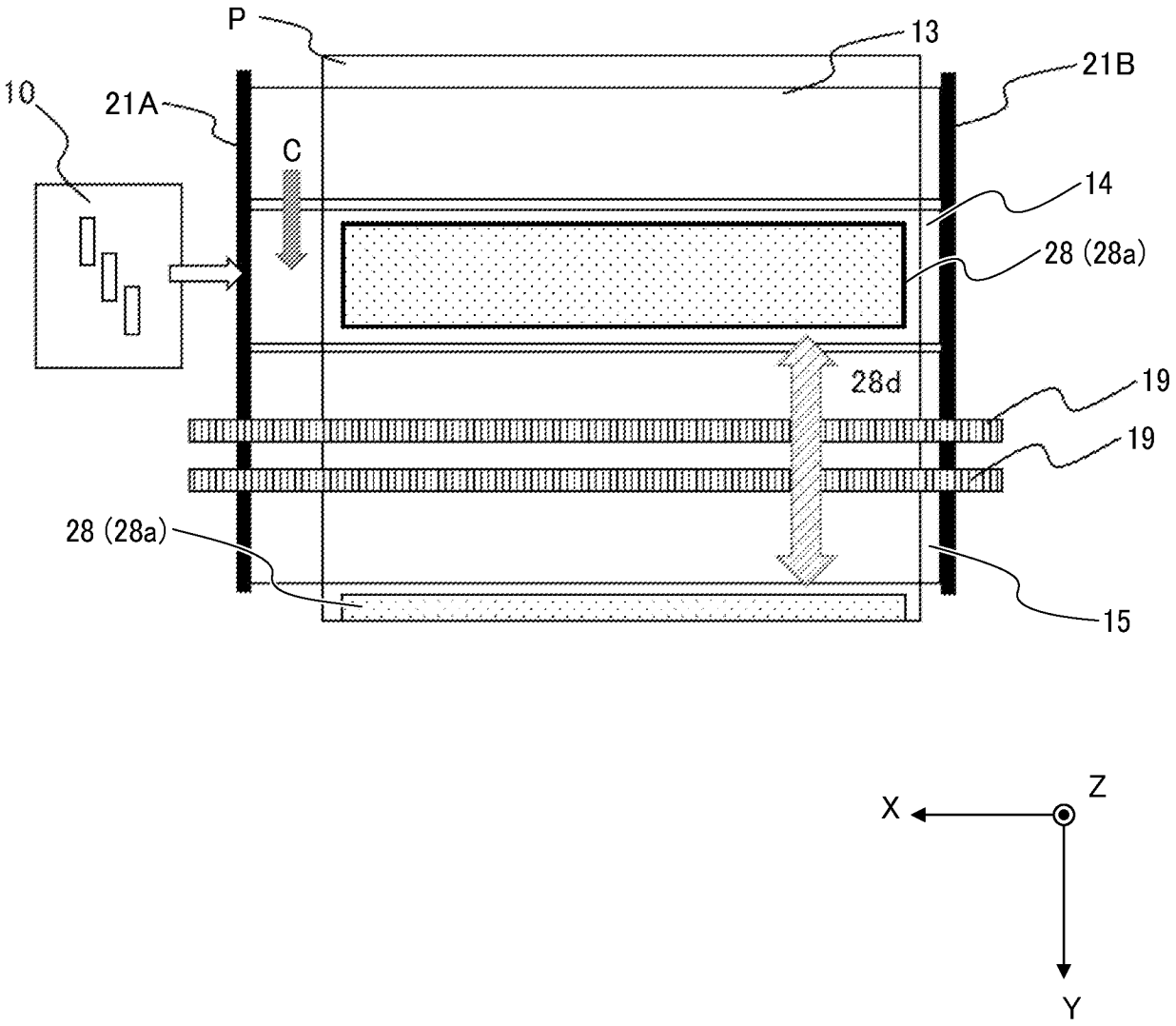
FIG. 12 is a schematic diagram illustrating the positional relation between the drying unit and the recording medium according to the comparative example.

A description is given of the sheet P when the next print job is performed after step S910. FIG. 11 illustrates a state of the sheet P when the next print job is started. FIG. 12 illustrates a state in which the print job has progressed from the state illustrated in FIG. 11. As illustrated in FIG. 11, a region from a start position 28*c* of the next liquid adhering area 28 formed by the next print job to the rear end 28*b* of the liquid adhering area 28 (image 28*a*) formed in the print job previously finished is a waste sheet region 28*d* as a blank region. The waste sheet region 28*d* is a region that is not used for image formation, that is, wasteful consumption of the sheet P. In the drying process according to the comparative example, the waste sheet region 28*d* once formed is not reduced. As illustrated in FIG. 12, the waste sheet region 28*d* is formed between the image 28*a* previously formed and the image 28*a* subsequently formed. Preferably, the waste sheet region 28*d* is reduced in the drying process.

Figure 13:
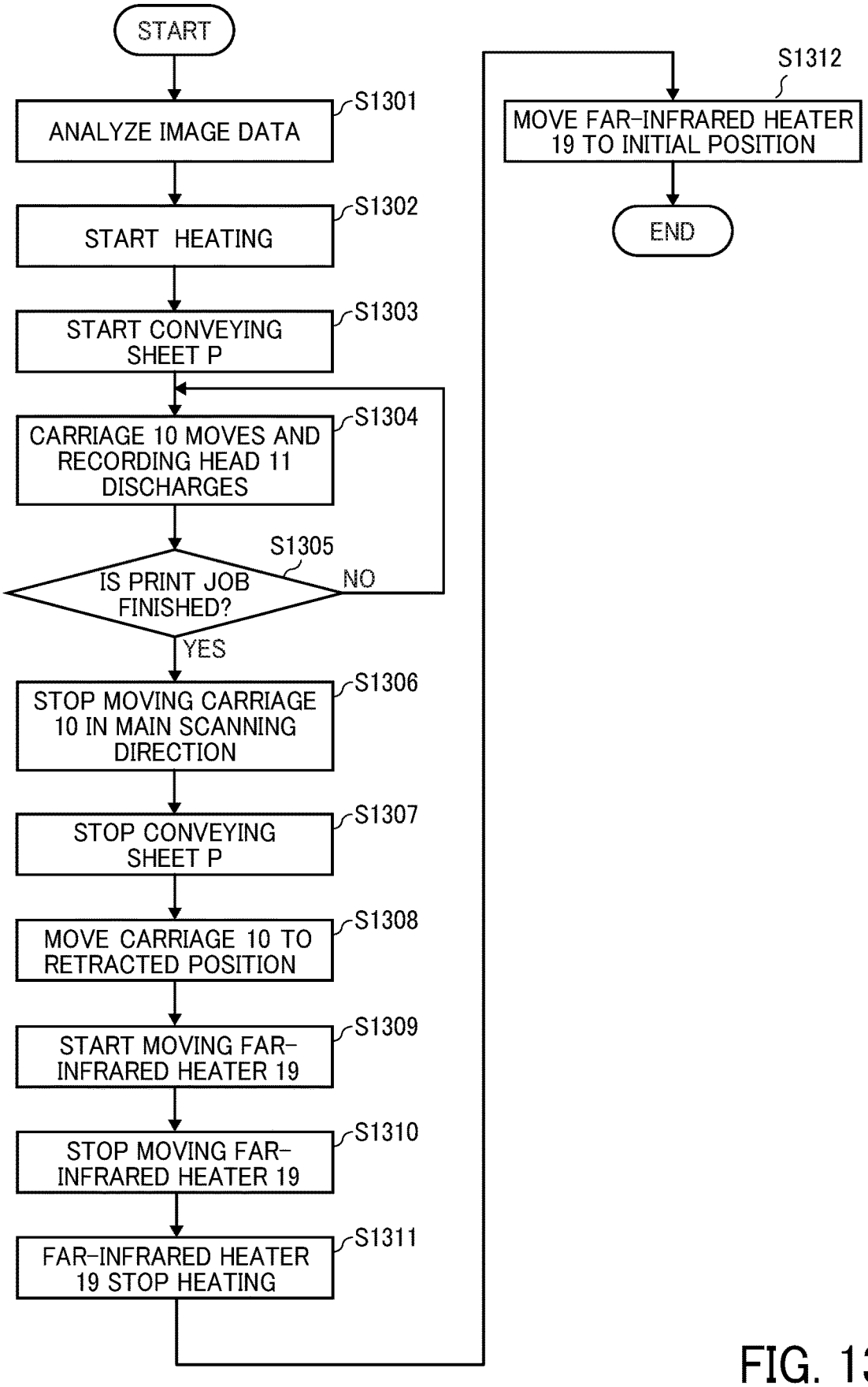
FIG. 13 is a flowchart illustrating the first embodiment of the drying process executed by the controller included in the inkjet printer.

Next, a first embodiment of a liquid discharge control process including the drying process of the printer 100 is described with reference to a flowchart illustrated in FIG. 13. Similarly to steps S901 to S906 in the comparative example (see FIG. 9), the CPU 102 reads and analyzes image data stored in the reception buffer of the I/F 107. The ASIC 106 performs the image processing on the image data analyzed by the CPU 102, and transmits the image data to the printing control unit 108. Then, the printing control unit 108 outputs the image data and drive signals to the head driver 116 at a required timing (S1301).

Subsequently, the heater control unit 112 causes the heaters including the far-infrared heater 19 to start heating (S1302). Then, the sub-scanning motor 118 drives the conveyance roller pair 12 to start conveying the sheet P (S1303). The head driver 116 applies the drive pulse to the pressure generator of the recording head 11, and the recording head 11 discharges the liquid ink while the main scanning motor 117 moves the carriage 10 in the main scanning direction (S1304).

Step S1304 is repeated until the printing control unit 108 finishes a series of image forming operations (print jobs) (No in S1305). When the print job is finished (Yes in S1305), the main scanning motor driver 109 stops the main scanning motor 117 to stop moving the carriage 10 in the main scanning direction to finish the main scanning of the carriage 10 (S1306). As illustrated in FIG. 10, the rear end 28*b* of the image 28*a* (the end position of the liquid adhering area 28) formed on the sheet P is conveyed to the downstream end of the platen plate 14 in the conveyance direction. At this time, the rear end 28*b* of the image 28*a* is located in a range where the carriage 10 (recording head 11) moves in the main scanning direction during the main scanning.

Figure 14:
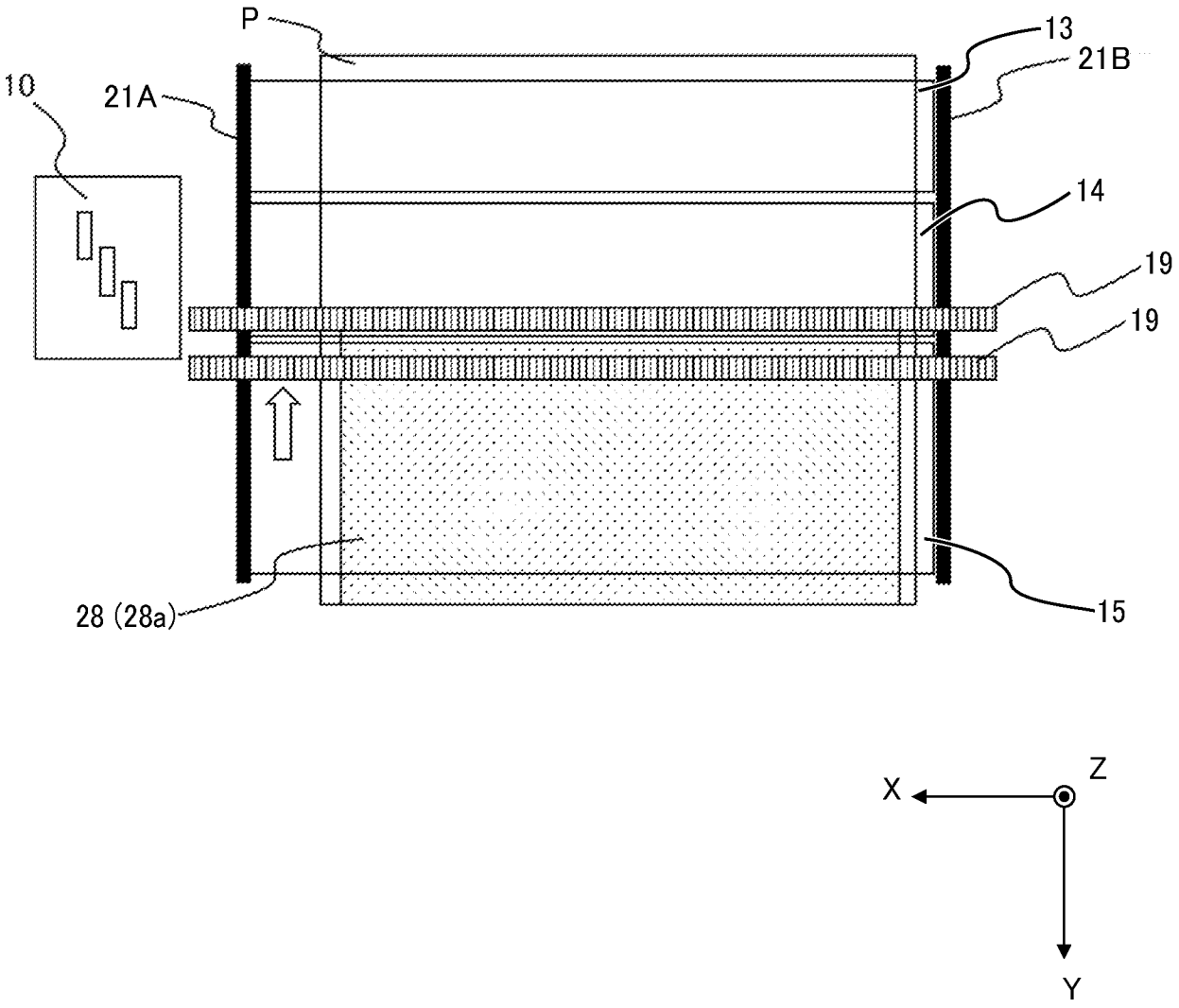
FIG. 14 is a schematic diagram illustrating the positional relation between the drying unit and the recording medium according to the first embodiment.

Then, the sub-scanning motor driver 110 causes the sub-scanning motor 118 to stop rotating, and the conveyance roller pair 12 stops conveying the sheet P (S1307). Subsequently, as illustrated in FIG. 14, the main scanning motor 117 moves the carriage 10 to the retracted position in the main scanning direction (first direction) (S1308). Here, the retracted position is out of the range where the carriage 10 moves during the main scanning, and is outside the inner side wall 21A holding the platen plate 14.

After the carriage 10 moves to the retracted position, the heater moving motor 126 moves the far-infrared heater 19 of the drying unit 29 to the rear end (downstream end in the conveyance direction) of the platen plate 14. At this time, the far-infrared heater 19 moves to a position facing a portion of the liquid adhering area 28 on the sheet P where the far-infrared heater 19 has not dried with the radiant heat (S1309).

Figure 15:
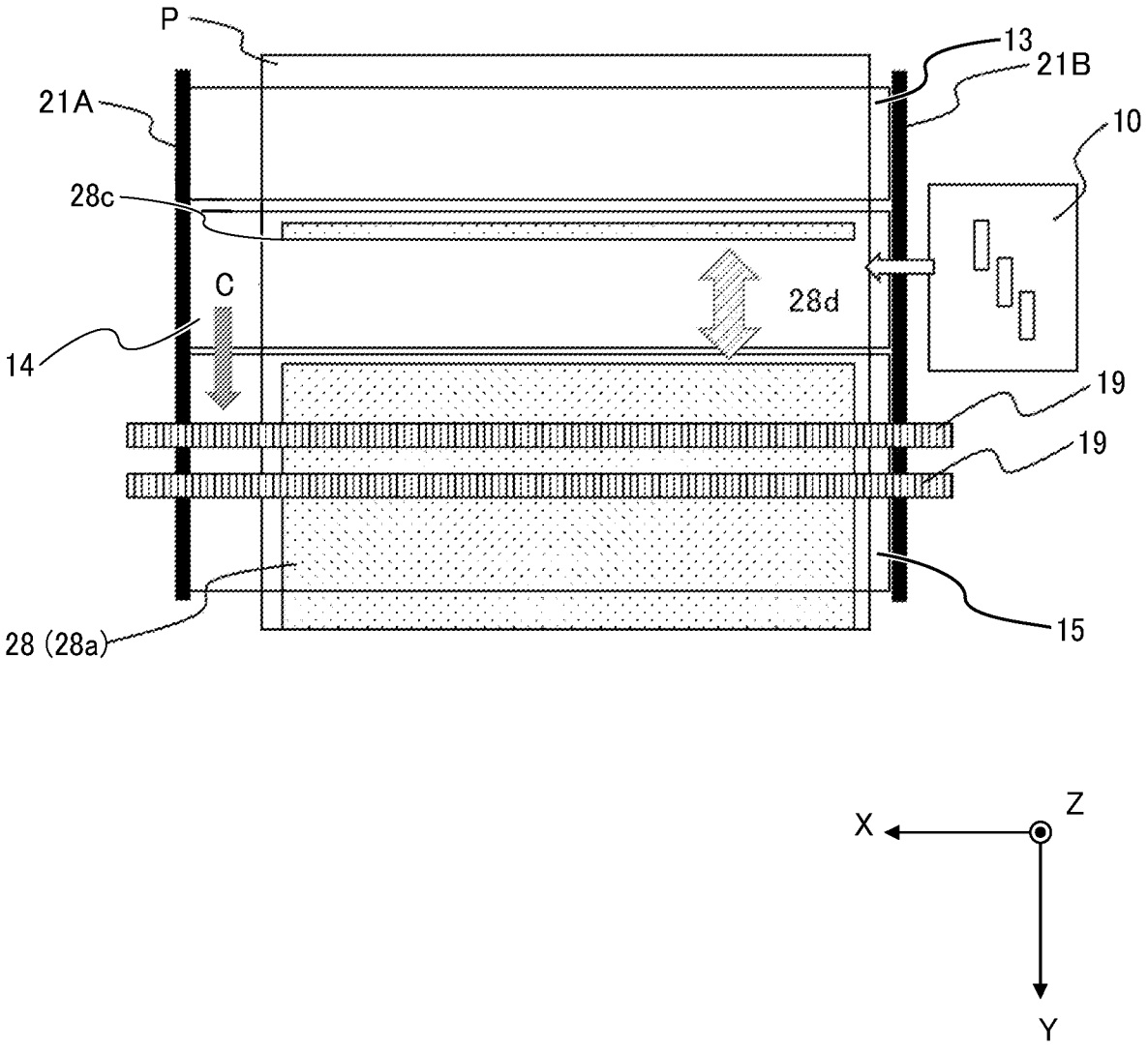
FIG. 15 is a schematic diagram illustrating the positional relation between the drying unit and the recording medium according to the first embodiment.

When the far-infrared heater 19 reaches the rear end 28*b* of the image 28*a*, the heater moving motor 126 stops moving the far-infrared heater 19 (S1310) to dry the liquid adhering area 28. After the liquid adhering area 28 has been dried, the heater control unit 112 causes the far-infrared heater 19 to stop heating (S1311). Then, as illustrated in FIG. 15, the heater moving motor 126 moves the far-infrared heater 19 to an initial position (home position) (S1312).

As described above, such a printing control process (liquid discharge control process) of the printer 100 according to the present embodiment can shorten the distance between the start position 28*c* of the liquid adhering area 28 in the next print job and the rear end 28*b* of the liquid adhering area 28 (the image 28*a*) formed in the previous print job as compared with the comparative example. That is, the waste sheet region 28*d* can be reduced. Thus, the amount of waste sheet can be reduced. In addition, according to the present embodiment, the liquid adhering area is not overheated, thereby preventing the image quality from deteriorating.

Figure 16:
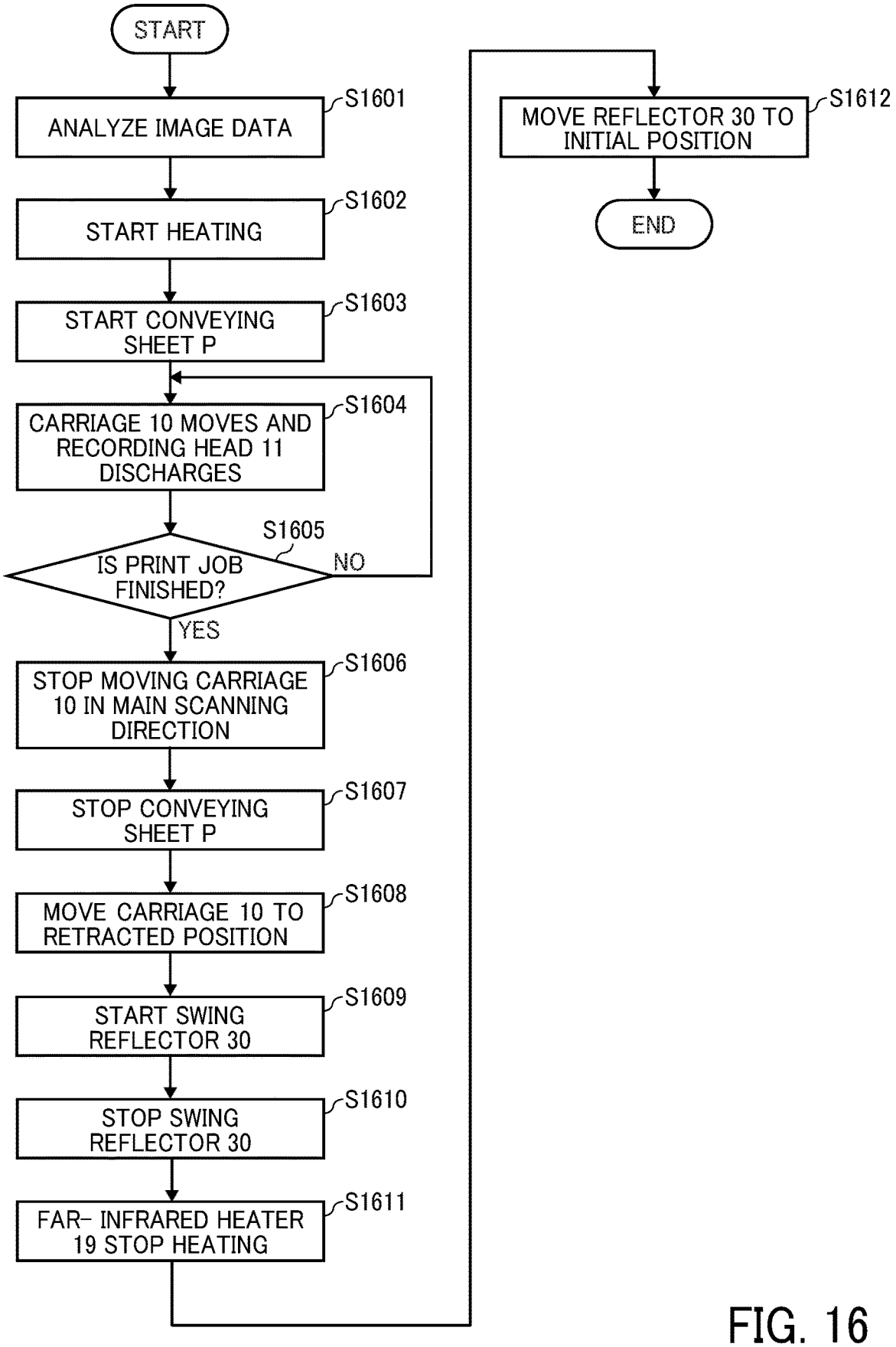
FIG. 16 is a flowchart illustrating the second embodiment of the drying process executed by the controller included in the inkjet printer.

Next, a second embodiment of the liquid discharge control process including the drying process of the printer 100 is described with reference to a flowchart illustrated in FIG. 16. Steps S1601 to S1608 according to the second embodiment are the same as steps S1301 to S1308 in the first embodiment described above, and thus detailed descriptions thereof are omitted.

As the printing control unit 108 finishes the image forming operation (Yes in S1605), the main scanning motor 117 stops moving the carriage 10 (S1606). The conveyance roller pair 12 stops conveying the sheet P (S1607). As illustrated in FIG. 14, after the carriage 10 moves to the retracted position (S1608) in the main scanning direction (first direction), the reflector control unit 125 causes the reflector motor 127 to swing the reflector 30 from the state illustrated in FIG. 7 to the state illustrated in FIG. 8 (S1609). That is, the reflector 30 swings upstream in the conveyance direction (second direction) to reflect the heat toward the end position of the liquid adhering surface to which the liquid ink adheres at the end of the liquid discharge operation. The reflector 30 reflects the radiant heat from the far-infrared heater 19 toward a portion of the liquid adhering area that has not been dried. As the reflector 30 swings, the liquid adhering area of the sheet P is dried by the radiant heat reflected on the reflector 30.

When the liquid adhering area has been dried, the reflector control unit 125 causes the reflector motor 127 to stop rotating. Thus, the reflector 30 stops swinging (S1610). Subsequently, the heater control unit 112 causes the far-infrared heater 19 to stop heating (S1611), and the reflector motor 127 returns the reflector 30 to an initial position (home position) illustrated in FIG. 7 (S1612).

In the present embodiment, the end of drying process of the liquid adhering area may be determined based on whether an elapsed time after the reflector 30 starts swinging exceeds a predetermined threshold time. In this case, the reflector 30 may be controlled to repeatedly swing between the state illustrated in FIG. 7 and the state illustrated in FIG. 8 based on an amount of liquid adhering to the liquid adhering area to be dried until the elapsed time exceeds the predetermined threshold time. In this case, the reflector 30 is controlled so as not to overheat the sheet P. When the drying process is performed using the heat reflected on the reflector 30, the threshold may be selectable depending on the material of the sheet P in addition to the amount of liquid adhering to the liquid adhering area.

As described above, such a printing control process (liquid discharge control process) of the printer 100 according to the present embodiment can shorten the distance between the start position 28*c* of the liquid adhering area 28 in the next print job and the rear end 28*b* of the liquid adhering area 28 (the image 28*a*) formed in the previous print job as compared with the comparative example. That is, the waste sheet region 28*d* can be reduced. Thus, the amount of waste sheet can be reduced. In addition, according to the present embodiment, the liquid adhering area is not overheated, thereby preventing the image quality from deteriorating.

As described above, according to the present disclosure, the blank region between liquid adhering areas can be reduced and the thermal deformation of the recording medium can be suppressed.

The present disclosure is not limited to specific embodiments described above, and numerous additional modifications and variations are possible in light of the teachings within the technical scope of the appended claims. It is therefore to be understood that, the disclosure of the present specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A liquid discharge apparatus comprising:

a liquid discharge head configured to perform a liquid discharge operation, the liquid discharge operation including discharging liquid onto a medium;

a drying unit configured to radiate heat to dry the liquid adhering to the medium; and circuitry configured to:

move the liquid discharge head; and change a drying target position on the medium after the liquid discharge head performs the liquid discharge operation, the drying target position being an area where the heat from the drying unit reaches, wherein during the change of the drying target position, the drying unit is moved in a conveyance direction of the medium to overlap a range in which the liquid discharge head moves during main scanning.

2. The liquid discharge apparatus according to claim 1, wherein the circuitry is configured to:

move the liquid discharge head to a retracted position in a first direction after the liquid discharge operation, the retracted position being out of a range of motion performed by the liquid discharge head during main scanning; and move the drying unit in a second direction perpendicular to the first direction to change the drying target position after the liquid discharge head moves to the retracted position.

3. The liquid discharge apparatus according to claim 2, wherein the circuitry is configured to move the drying unit toward an end position on the medium to which the liquid adhered at an end of the liquid discharge operation.

4. The liquid discharge apparatus according to claim 2, further comprising a conveyance unit configured to convey the medium at a conveyance speed, wherein the circuitry is configured to move the drying unit at a speed depending on the conveyance speed.

5. The liquid discharge apparatus according to claim 2, wherein the drying unit is configured to radiate the heat while moving.

6. The liquid discharge apparatus according to claim 1, further comprising a reflector configured to reflect the heat radiated by the drying unit, wherein the circuitry is configured to:

move the liquid discharge head in a first direction; and swing the reflector to reflect the heat in a second direction perpendicular to the first direction after the liquid discharge operation.

7. The liquid discharge apparatus according to claim 6, wherein the circuitry configured to swing the reflector to reflect the heat toward an end position on the medium to which the liquid adhered at an end of the liquid discharge operation.

8. The liquid discharge apparatus according to claim 1, wherein the drying unit includes a heater configured to heat the medium in a non-contact manner.

9. A liquid discharge method comprising:

causing a liquid discharge head to discharge liquid onto a medium while moving the liquid discharge head;

causing a drying unit to radiate heat to dry the liquid adhering to the medium; and changing a drying target position on the medium after the liquid discharge head discharges the liquid onto the medium, the drying target position being an area where the heat reaches, wherein during changing of the drying target position, the drying unit is moved in a conveyance direction of the medium to overlap a range in which the liquid discharge head moves during main scanning.

* * * * *